United States Patent [19]

Katabuchi

[11] Patent Number: 4,465,523

[45] Date of Patent: Aug. 14, 1984

[54] METHOD OF QUENCHING METALS

[75] Inventor: Tadashi Katabuchi, Chiba, Japan

[73] Assignee: Idemitsu Kosan Company Limited, Japan

[21] Appl. No.: 483,489

[22] Filed: Apr. 11, 1983

[30] Foreign Application Priority Data

Apr. 26, 1982 [JP] Japan ..... 57-68581

[51] Int. Cl.[3] ..... C10M 1/52; C21D 1/44; C21D 1/56

[52] U.S. Cl. ..... 148/18; 148/20.6; 148/28; 148/29; 148/30

[58] Field of Search ..... 148/18, 20.6, 28, 29, 148/30

[56] References Cited

U.S. PATENT DOCUMENTS

| | | | |
|---|---|---|---|
| 3,400,140 | 9/1968 | Rowan et al. | 252/49.7 |
| 3,509,051 | 4/1970 | Farmer et al. | 252/33.6 |
| 3,729,417 | 4/1973 | Hashimoto et al. | 148/29 |

*Primary Examiner*—Veronica O'Keefe

*Attorney, Agent, or Firm*—McGlew and Tuttle

[57] ABSTRACT

A method of quenching metals is described, comprising immersing said metals in a quenching oil composition comprising: (a) a base oil, and (b) a compound represented by the general formula (1) or (2) as described below.

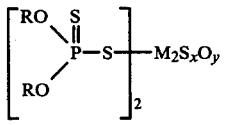

(1)

$$[R_2N-CS-S]_2-M_2O_mS_n \quad (2)$$

(wherein all the symbols are the same as defined in the claims). The use of the quenching oil composition results in the formation of a black coating layer on the metal, producing those metallic articles having improved characteristics, such as good lubricity and rust preventive properties.

6 Claims, No Drawings

METHOD OF QUENCHING METALS

BACKGROUND OF THE INVENTION

1. Field of the Invention

The present invention relates to a method of quenching metals.

2. Description of the Prior Art

A heat treating oil is called a quenching oil and is used to increase the mechanical strength of metal, but cannot provide a rust preventive ability and lubricity. Thus, various attempts have been made to provide such a rust preventive ability and lubricity, including a surface treatment in which a black coating layer is formed on the surface of metal while at the same time achieving the quenching of the metal. For this purpose, several heat treating oil compositions have been proposed as described in, for example, Japanese Patent Publication Nos. 20806/1972, 32288/1974, and 33484/1975. In fact, a heat treating oil composition comprising a base oil consisting of a mineral oil, and zinc alkyldithiophosphate is widely used.

This heat treating oil composition, however, creates various problems, for example:

(1) At a quenching step, particularly at a carburizing quenching step, the zinc compound decomposes upon heating and evaporates, depositing on the metal surface and preventing the formation of the desired black coating layer thereon;

(2) Since the reactivity of the zinc compound with metals is low, the adhesive properties and rust preventive ability of the coating layer is inferior, and furthermore, on a planished surface and a bonderized surface, the black coating layer is formed only unevenly;

(3) The coefficient of friction of the metal that has been quenched is high, and characteristics, such as anti-seizuring properties and fatigue life (anti-pitting life), are not sufficiently satisfactory, which is a serious problem particularly in the case of parts, such as constant velocity joints; and (4) In the case of bolts which are tempered at high temperatures of from 500° to 600° C., the desired coating layer is not formed by a treatment starting at the tempering temperature, because the reactivity of the zinc compound is low.

SUMMARY OF THE INVENTION

An object of the present invention is to provide a metal quenching method which overcomes all the above-described problems.

The present invention relates to a method of quenching metal which comprises immersing said metal in a heat treating oil comprising:

(a) a base oil; and (b) sulfurized oxymetal organophosphorodithioate represented by the general formula:

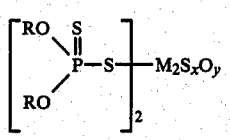

(1)

wherein M is molybdenum (Mo) or tungsten (W), R contains from 1 to 30 carbon atoms, and is an alkyl group, a cycloalkyl group, an aryl group, or an alkylaryl group, and x and y are each a positive real number provided that $x+y=4$, or sulfurized oxymetal dithiocarbamate represented by the general formula:

$$[R_2N—CS—S]_2—M_2O_mS_n \quad (2)$$

wherein M is Mo or W, R contains from 1 to 30 carbon atoms, and is an alkyl group, a cycloalkyl group, an aryl group, or an alkylaryl group, and m and n are each a positive real number provided that $m+n=4$.

DETAILED DESCRIPTION OF THE INVENTION

The base oil which is used as a diluent in the present invention is not critical or is not subjected to special limitations. For example, mineral oil, synthetic lubricating oil, and a mixture thereof can be used. In general, the base oil has a dynamic viscosity at 100° C. of at least 1.5 centistokes and preferably from 2 to 50 centistokes.

The sulfurized oxymetal organophosphorodithioate represented by the general formula (1) can be prepared, for example, by a method as described in Japanese Patent Publication No. 27366/1969 (corresponding to U.S. Pat. No. 3,400,140). Suitable examples of the compounds of the general formula (1) are sulfurized oxymolybdenum diisopropylphosphorodithioate, sulfurized oxytungsten diisopropylphosphorodithioate, sulfurized oxymolybdenum diisobutylphosphorodithioate, sulfurized oxymolybdenum di(2-ethylhexyl)phosphorodithioate, sulfurized oxymolybdenum di(p-tert-butylphenyl)phosphorodithioate, sulfurized oxytungsten di(p-tert-butylphenyl)phosphorodithioate, sulfurized oxymolybdenum di(nonylphenyl)phosphorodithioate, etc.

The sulfurized oxymetal dithiocarbamate represented by the general formula (2) can be prepared, for example, by a method as described in Japanese Patent Publication No. 6362/1974 (corresponding to U.S. Pat. No. 3,509,051). Suitable examples of the compounds of the general formula (2) are sulfurized oxymolybdenum dibutyldithiocarbamate, sulfurized oxytungsten dibutyldithiocarbamate, sulfurized oxymolybdenum diethyldithiocarbamate, sulfurized oxytungsten di(2-ethylhexyl)dithiocarbamate, sulfurized oxymolybdenum diamyldithiocarbamate, sulfurized oxymolybdenum dilauryldithiocarbamate, sulfurized oxymolybdenum di(oleyllinoleyl)dithiocarbamate, etc.

The amount of the additive, the compound of the general formula (1) or (2), being added is at least 0.01 part by weight per 100 parts by weight of the base oil, with the range of from 0.1 to 50 parts by weight being particularly preferred. When the amount of the additive used is less than 0.01 part by weight, a thin and uneven coating layer results, and the object of the invention cannot be attained sufficiently. On the other hand, when it is more than 50 parts by weight, peeling of the resulting coating layer may sometimes occur.

Various metals can be quenched in accordance with the process of the invention. Typical examples are alloys, particularly iron base alloys and carbon steels. Articles made of such metals are heated and, thereafter, quenched by immersing said articles in the quenching oil composition of the invention. Although the temperature to which the metallic article is heated varies with the properties of the metal, it is generally from about 800° to 900° C. in the case of carbon steels and about 500° C. in the case of aluminum alloys. The temperature of a bath containing the quenching oil composition is maintained usually at a temperature of from about 10° to 250° C.

By using the quenching oil composition of the invention, the desired black coating layer can be formed even on a planished surface and a bonderized surface. This results in the formation of the passive state of metal. Furthermore, the black coating layer provides good lubricity. Thus, the quenching of metal with the quenching oil composition of the invention lowers the coefficient of friction of the metal and increases the anti-seizuring properties thereof, and furthermore, prolongs the fatigue life thereof.

The quenching oil composition of the invention can also be used in a high temperature (ranging between about 350° and 650° C.) tempering treatment.

The vapor pressures of the additives as used herein are very low and, therefore, they do not cause contamination of the interior of a furnace in the quenching of carburized metals. Thus, the additives as used herein do not inhibit the formation of the desired black coating layer on metals.

The following examples and comparative example are given to illustrate the invention in greater detail.

EXAMPLE 1

A paraffin base mineral oil (dynamic viscosity at 100° C.; 10 centistokes) was used as a base oil, and sulfurized oxymolybdenum di(2-ethylhexyl)phosphorodithioate was added thereto in a proportion of 2% by weight to prepare a quenching oil composition.

The thus-prepared oil composition was subjected to the tests as described below. The results are shown in Table I.

(1) Seizure Load Test

A Falex test pin (AISI 3135, ¼ inch wide and 1¼ inch length) was heated in a reducing gas atmosphere (a mixed gas of 75% by weight $N_2$ and 25% by weight $H_2$) at 830° C. for 1 hour. At the end of the time, the pin was thrown into the quenching oil composition maintained at 125° C. to quench it. The thus-quenched pin was subjected to the Falex anti-seizuring test.

(2) Fatigue Life Test

Four balls (SUJ-2, ¾ inch) for the four ball test were quenched in the same manner as in (1) above and, thereafter, the four rolling ball test was performed using a Soda type four ball testing machine to evaluate the anti-fatigue life. This test was performed under a load of 745 kilograms and at a number of revolution of 1,500 rpm, and the 50% life of the Weibull distribution was employed.

(3) Coefficient of Friction and Appearance Test

A ball (SUJ-2, ½ inch) for the four ball test was quenched at 830° C. and then, tempered at 600° C. The coefficient of friction of the ball was measured on a reciprocating friction testing machine under the conditions of load of 2 kilograms per square millimeter and sliding rate of 1 centimeter per second. Also, the appearance of the ball was observed.

EXAMPLE 2

The procedure of Example 1 was repeated with the exception that sulfurized oxymolybdenum diamyldithiocarbamate was used as an additive in place of the sulfurized oxymolybdenum di(2-ethylhexyl)phosphorodithioate. The results are shown in Table 1.

COMPARATIVE EXAMPLE

The procedure of Example 1 was repeated with the exception that sulfurized oxyzinc di(2-ethylhexyl)dithiophosphate was used as an additive in place of the sulfurized oxymolybdenum di(2-ethylhexyl)phosphorodithioate. The results are shown in Table 1.

TABLE 1

| Run No. | Seizure Load (pounds) | Fatigue Life (minutes) | Coefficient of Friction | Appearance |
|---|---|---|---|---|
| Example 1 | 2,400 | 38 | 0.10 | good |
| Example 2 | 2,700 | 45 | 0.10 | good |
| Comparative Example | 1,700 | 37 | 0.12 | uneven |

EXAMPLE 3

A piece of iron which had been planished together with the ball quenched using the quenching oil composition of Example 2 under the same conditions of Fatigue Life Test in Example 1 was heated in a reducing gas (a mixed gas of 75% by weight $N_2$ and 25% by weight $H_2$) up to 830° C.

Then, the iron piece was taken out and was subjected to copper plating. Good copper plating could be achieved. When, on the other hand, the same procedure as above was repeated with the exception that the quenching oil composition of Comparative Example was used, the ferrous piece was plated unevenly and no satisfactory copper plating could be achieved. This shows that the surface of the iron piece is contaminated.

EXAMPLE 4

A hexagon nut (JIS-1, $M_8$) which had been subjected to a bonderizing treatment was heated in a reducing gas (a mixed gas of 75% by weight $N_2$ and 25% by weight $H_2$) at 830° C. for 1 hour. At the end of the time, the hexagon nut was quenched by immersing in the same quenching oil composition maintained at 125° C. as used in Example 1 or in Comparative Example.

Observation of the surface of the above-quenched hexagon nut showed that the quenching using the oil composition of Example 1 produced a good black coating layer, whereas the coating layer produced using the oil composition of Comparative Example was not uniform and partially peeled apart.

What is claimed is:

1. A method of quenching metal which comprises immersing said metal in a quenching oil composition comprising:

(a) a base oil; and (b) a compound represented by the general formula (1):

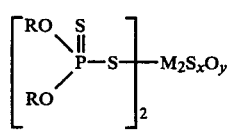

(1)

(wherein M is molybdenum (Mo) or tungsten (W), R contains from 1 to 30 carbon atoms, and is an alkyl group, a cycloalkyl group, an aryl group, or an alkylaryl group, and x and y are each a positive real number provided that $x+y=4$), or a compound represented by the general formula (2):

$$[R_2N—CS—S]_2—M_2O_mS_n \quad (2)$$

(wherein M is Mo or W, R contains from 1 to 30 carbon atoms, and is an alkyl group, a cycloalkyl group, an acryl group, or an alkylaryl group, and m and n are each a positive real number provided that m+n=4).

2. The method as claimed in claim 1, wherein the base oil has a dynamic viscosity at 100° C. of at least 1.5 centistokes.

3. The method as claimed in claim 1, wherein an addition amount of the compound represents by the general formula (1) or (2) is from 0.1 to 50 parts by weight based on 100 parts by weight of the base oil.

4. The method as claimed in claim 1, wherein the compound represents by the general formula (1) is sulfurized oxymolybdenum di(2-ethylhexyl)phosphorodithioate.

5. The method as claimed in claim 1, wherein the compound represents by the general formula (2) is sulfurized oxymolybdenum diamyldithiocarbamate.

6. A method of quenching metal which comprises immersing said metal in a quenching oil composition consisting essentially of (a) a base oil; and (b) a compound represented by the general formula (1):

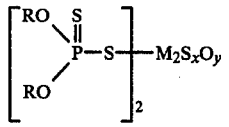

(1)

wherein (M is molybdenum (Mo) or tungsten (W), R contains from 1 to 30 carbon atoms, and is an alkyl group, a cycloalkyl group, an aryl group, or an alkylaryl group, and x and y are each a positive real number provided that x+y=4), or a compound represented by the general formula (2):

$$[R_2N—CS—S]_2—M_2O_mS_n \quad (2)$$

(wherein M is Mo or W, R contains from 1 to 30 carbon atoms, and is an alkyl group, a cycloalkyl group, an acryl group, or an alkylaryl group, and m and n are each a positive real number provided that m+n=4.

* * * * *